US005161859A

United States Patent [19]

Larsson et al.

[11] Patent Number: 5,161,859

[45] Date of Patent: Nov. 10, 1992

[54] EXCAVATING TOOL CUTTING INSERT

[75] Inventors: Kenneth L. Larsson; Bert G. Levefelt, both of Sandviken, Sweden

[73] Assignee: Santrade Limited, Luzerne, Switzerland

[21] Appl. No.: 708,058

[22] Filed: May 30, 1991

Related U.S. Application Data

[63] Continuation of Ser. No. 517,023, May 1, 1990, abandoned, which is a continuation of Ser. No. 586,818, Mar. 6, 1984, Pat. No. 4,938,538.

[30] Foreign Application Priority Data

Mar. 23, 1983 [SE] Sweden ..... 8301584.2

[51] Int. Cl.[5] ..... E21C 35/18

[52] U.S. Cl. ..... 299/86; 175/427

[58] Field of Search ..... 175/410; 299/79, 86, 299/91

[56] References Cited

U.S. PATENT DOCUMENTS

| | | | |
|---|---|---|---|
| 2,847,921 | 8/1958 | Heckathorn . | |
| 3,198,609 | 8/1965 | Cape . | |
| 3,239,275 | 3/1966 | Belugou | 299/79 |
| 3,268,259 | 8/1966 | Snipe | 299/91 |
| 3,279,049 | 10/1966 | Ellis et al. . | |
| 3,296,693 | 1/1967 | Carter . | |
| 3,356,418 | 12/1967 | Healey et al. | 299/91 |
| 3,444,613 | 5/1969 | Foerster . | |
| 3,519,309 | 7/1970 | Engle et al. | 299/86 |
| 3,830,321 | 8/1974 | McKenry et al. | 175/332 |
| 3,830,546 | 8/1974 | Kniff | 299/86 |
| 3,957,307 | 5/1976 | Varda | 299/86 |
| 3,997,011 | 12/1976 | Staroba | 175/400 |
| 4,065,185 | 12/1977 | Elders | 299/86 |
| 4,108,260 | 8/1978 | Bozarth | 175/374 |
| 4,194,791 | 3/1980 | Montgomery, Jr. et al. | 299/86 |
| 4,201,421 | 5/1980 | Den Besten et al. | 299/86 |
| 4,216,832 | 8/1980 | Stephenson et al. | 172/540 |
| 4,340,650 | 7/1982 | Pattanaik et al. | 428/675 |
| 4,389,074 | 6/1983 | Greenfield | 299/79 |
| 4,497,520 | 1/1985 | Ojanen | 299/86 |
| 4,547,020 | 10/1985 | Ojanen | 299/86 |
| 4,725,099 | 2/1988 | Penkunas et al. | 299/86 |
| 4,893,875 | 1/1990 | Lonn et al. | 299/86 X |
| 4,991,503 | 3/1990 | Stiffler et al. | 299/79 |

FOREIGN PATENT DOCUMENTS

| | | | |
|---|---|---|---|
| 503496 | 7/1977 | Australia . | |
| 25421 | 3/1981 | European Pat. Off. . | |
| 1939890 | 6/1971 | Fed. Rep. of Germany . | |
| 2311400 | 12/1974 | Fed. Rep. of Germany . | |
| 2846744 | 10/1978 | Fed. Rep. of Germany . | |
| 3510072 | 9/1986 | Fed. Rep. of Germany | 299/91 |
| 190452 | 7/1964 | Sweden . | |
| 191515 | 9/1964 | Sweden . | |
| 8400269 | 1/1984 | Sweden | 299/86 |
| 495436 | 3/1976 | U.S.S.R. . | |
| 474595 | 6/1976 | U.S.S.R. . | |
| 829917 | 5/1981 | U.S.S.R. . | |
| 899916 | 1/1982 | U.S.S.R. . | |
| 1044920 | 10/1966 | United Kingdom . | |
| 1110495 | 4/1968 | United Kingdom . | |
| 1112446 | 5/1968 | United Kingdom . | |
| 1294717 | 11/1972 | United Kingdom . | |
| 1601470 | 10/1981 | United Kingdom . | |

OTHER PUBLICATIONS

Webster's Ninth New Collegiate Dictionary, Merriam-Webster Inc., pp. 146, 494, 1984.

*Designing with Kennametal*, 1978.

*Creating with metal powders*, Hoeganaes Corp., 1971.

American Mine Tool Div. of GTE Products Corp., Drawing, Sep. 1982.

(List continued on next page.)

*Primary Examiner*—David J. Bagnell

*Attorney, Agent, or Firm*—Burns, Doane, Swecker & Mathis

[57] ABSTRACT

The invention relates to a tool for breaking or excavating of hard material, such as asphalt. The tool comprises a cutting insert (11) secured to a tool body (10). For purposes maintaining the required cutting force low while ensuring that the risk is low that the cutting insert (11) will get loose the cutting insert (11) is provided with a concave portion (17[1]) between the tip portion (12) of the cutting insert and a rear shoulder (13) thereon.

9 Claims, 1 Drawing Sheet

OTHER PUBLICATIONS

Affidavit of Edmund Isakov, Feb. 9, 1988.
Declaration of German S. Genfan, May 20, 1988.
Declaration of Jerry Ponton (undated).
Declaration of Dwight Nickell (undated).
Declaration of Wayne Beach (undated).
Declaration of Randall W. Ojanen (undated).
Declaration of John Boaz (undated).
Declaration of Bruce Pryor (undated).
Declaration of Almedia Johnson (undated).
Declaration of Curnie Dunn (undated).
Declaration of Jeffrey Blue.
Guy, *Elements of Physical Metallurgy*, pp. vii–ix, 299–301 (1951).
Peterson, *Stress Concentration Design Factors*, pp. 64–65. (1953).
DeGroat, *Tooling for Metal Powder Parts*, pp. 29–50. (1958).
*Construction tools*, by Kennametal, (1977).
*Construction tools*, by Kennametal. (1975).
*Construction tools*, by Kennametal. (1976).
"Schneidende Bewinnung auf der Bergbau 81", *Gluck-auf*, vol. 117, No. 18, Sep. 1981, pp. 1167–1169.
*Kennametal* catalog, 1975, p. 8.
*Kennametal* catalog, 1977, one page. excerpt.
*Kennametal* catalog, 1979, one page excerpt.
VR/Wesson Company, Catalog, 503, Jan. 1967, pp. 1–12.
Multi-Metals Engineering, Dwg. No. C1445, dated Mar. 1972.
Multi-Metals Engineering Dwg. No. C1445–7, Sep. 1973.
Carboloy Dwg. No. 113312, Mar. 1979.
Carboloy Dwg. No. 131312, Aug. 1979.
Carboloy Dwg. No. MA-32039, Feb. 1979.
Carboloy Dwg. No. MA-32055, Aug. 1979.
Carboloy Dwg. No. MA-91312, Mar. 1979.
Carboloy catalog, 1980.
Kennametal, "Designing with Kennametal", Copyright 1967 (excerpts).

EXCAVATING TOOL CUTTING INSERT

This application is a continuation of application Ser. No. 07/517,023, filed May 1, 1990, now abandoned, which is a continuation of application Ser. No. 06/586,818, filed Mar. 6, 1984, now U.S. Pat. No. 4,938,538.

The present invention relates to a tool for breaking or excavating of hard material, such as asphalt, comprising a tool body and a cutting insert secured thereto, for instance by brazing. The cutting insert is formed with a generally conical tip portion and provided with a shoulder which is intended to rest against a supporting surface on the tool body.

The purpose of the invention is to provide a tool of the above type which requires a low cutting force at the same time as it is ensured that the risk is low that the cutting insert will get loose even during working in wear resistant material.

This and other objects have been attained by giving the invention the characterizing features stated in the appending claims.

The invention is described in detail in the following with reference to the accompanying drawings, in which one embodiment is shown by way of example. It is to be understood that this embodiment is only illustrative of the invention and that various modifications thereof may be made within the scope of the claims.

In the drawings.

Corresponding details in the various figures have been given the same reference numeral.

Tools of the type in question are usually mounted rotatably in a tool holder, which in its turn is attached to an excavating machine, such as a road planing machine or a mining machine. Due to its rotation the tool is self-sharpening. The machine might be of the type disclosed in EP-A-25421.

Figure 1:
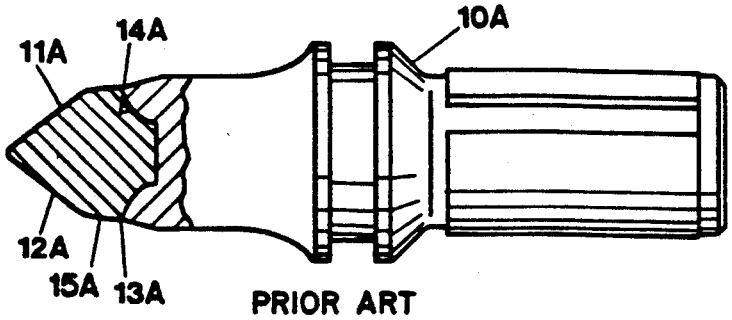
PRIOR ART Fig.1
FIG. 1 shows a side view, partly in section, of a prior art tool for breaking hard material.

For breaking or excavating of wear resistant material, for instance for milling in poured asphalt (mastic), tools are used of the type shown in FIG. 1. This tool comprises a tool body 10A and a cutting insert 11A of hard metal. The cutting insert 11A is provided with a conical tip portion 12A and a shoulder 13A which is intended to rest against a supporting surface 14A on the tool body 10A. The rear contact surface 20A of the shoulder 13A is brazed to the supporting surface 14A. The cutting insert 11A is provided with a conical intermediate portion 15A which is located between the tip portion 12A and the shoulder 13A. The portion 15A protects the portion of the tool body 10A, the tool body being made of steel, surrounding the cutting insert 11A from such wear that would cause the cutting insert 11A to get loose. When wear resistant material is excavated, for instance during milling in poured asphalt, the tip portion 12A becomes blunt-ended upon some wear of the cutting insert 11A. This wear increases the required cutting force. When milling in poured asphalt the increase of the required cutting force might even have the result that the road planing machine does not manage to rotate the cutter drum upon which the tools are mounted.

Figure 2:
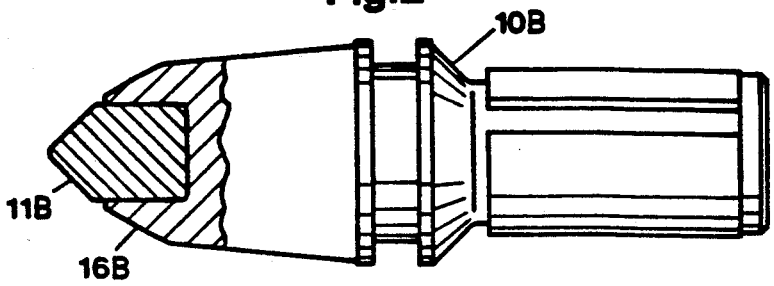
PRIOR ART Fig.2
FIG. 2 shows a side view, partly in section, of another prior art tool.

One way of decreasing the cutting force required for worn tools would be to use a tool of the type shown in FIG. 2. since the cutting insert 11B has a smaller diameter than the cutting insert 11A. However, this should mean that the portion 16B of the tool body 10B surrounding the cutting insert 11B rapidly would be abraded, thereby causing the cutting insert 11B to get loose. Thus, cutting inserts of the type shown in FIG. 2 are suitable for use solely where the hard metal determines the life of the tool, for instance milling in concrete.

Figure 3:
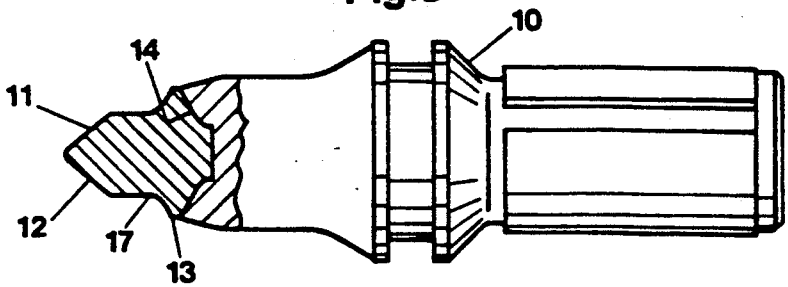
FIG. 3 shows one embodiment of a tool according to the invention.
Figure 4:
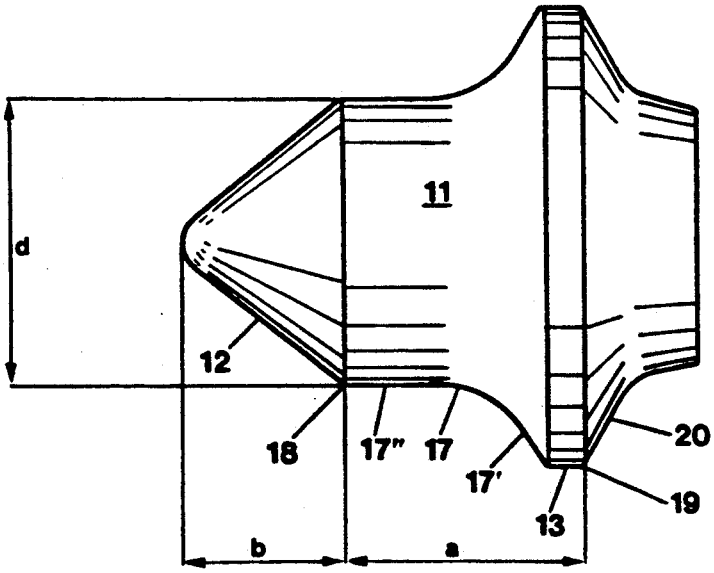
FIG. 4 shows an enlarged scale the cutting insert in the tool shown in FIG. 3.

As shown in FIGS. 3 and 4 the cutting insert 11 in a tool according to the invention is provided with an intermediate portion 17 between the tip portion 12 and the shoulder 13; said intermediate portion comprising a concave portion $17^1$. Due to the intermediate surface portion 17 the required cutting force is maintained low even when the tip portion 12 becomes worn, since the tip size remains generally the same as the tip wears down along the intermediate surface portion 17. Due to this design it is also ensured that the steel in the tool body 10 surrounding the cutting insert is protected against premature abrasion; this protection being provided by the concave portion $17^1$ and the shoulder 13.

According to a preferred embodiment (FIG. 4) the portion 17 comprises a circular-cylindrical portion $17^{11}$ located adjacent to the tip portion 12. Further in this embodiment the distance "a" from the transition 18 between the tip portion 12 and the intermediate portion 17 to the radially outermost portion 19 of the rear contact surface 20 of the shoulder 13 is larger than the distance "b" from the transition 18 to the axially forwardmost portion of the tip portion 12; said rear contact surface being intended to rest against the supporting surface 14 of the tool body 10.

Further, in the illustrated embodiment, the smallest diameter "d" of the concave portion $17^1$ is smaller than the sum of the above-defined distances "a" and "b". The concave portion $17^1$ is provided with a constant radius of curvature, which is in the same order as half the above-mentioned smallest diameter "d", preferably somewhat smaller than said diameter.

The enveloping surface of the cylindrical portion $17^{11}$ extends tangentially to the arc-shaped portion $17^1$.

In the illustrated embodiment the cutting insert is provided with a rear portion projecting rearwardly from the shoulder 13. The end surface of this portion is planar. It might, however, be recessed, for instance half-spherical or of the general W-shape illustrated in Swedish Patent Application No. 8400269-0. The bottom of the recess might rest against a correspondingly shaped protrusion on the tool body, or, alternatively, the recess might provide a cavity.

In a further modification the cutting insert might be made without a rear projection. The rear end surface of the cutting insert, i.e. the end surface of the shoulder, and the cooperating front surface of the tool body might be designed according to any of the above alternatives.

We claim:

1. A rotatable excavating tool for breaking hard material, comprising:

an elongated tool body having an end with a diameter and a supporting surface; and a cutting insert of hard metal having a generally conical tip portion, a shoulder with a diameter substantially larger than the maximum diameter of the tip portion, an elongated intermediate portion integral with and extending between the generally conical tip portion and the shoulder, defining an abrupt transition from the generally conical tip portion, and having a maximum diameter which is substantially less than the diameter of the tool body end, the intermediate portion comprising a concave surface portion, the intermediate portion extending radially outwardly between the generally conical tip portion and the shoulder, said shoulder integrally joining the concave surface portion, and a rearwardly facing contact surface attached to the supporting surface of the tool body.

2. A rotatable excavating tool for breaking hard material, comprising:

an elongated tool body having an end with a diameter and a supporting surface; and a cutting insert of hard metal having a generally conical tip portion, a shoulder with a diameter substantially larger than the maximum diameter of the tip portion, an elongated intermediate portion integral with and extending axially and radially between the generally conical tip portion and the shoulder, defining an abrupt transition from the generally conical tip portion, and having a maximum diameter which is substantially less than the diameter of the tool body end, the intermediate portion comprising a concave surface portion, said shoulder integrally joining the concave surface portion, and a rearwardly facing contact surface attached to the supporting surface of the tool body.

3. The rotatable excavating tool for breaking hard material of claim 2 wherein the concave surface portion has a constant radius of curvature.

4. A tool according to claim 3, wherein the distance (a) from the abrupt transition between the generally conical tip portion and the intermediate surface portion the radially outermost portion of the rearwardly facing contact surface of the shoulder is larger than the distance (b) from said abrupt transition to the axially forwardmost portion of the generally conical tip portion.

5. A tool according to claim 4, wherein the smallest diameter (d) of the concave surface portion is smaller than the distance (a+b) from the axially forwardmost portion of the generally conical tip portion to the radially outermost portion of the rearwardly facing contact surface of the shoulder.

6. A tool according to claim 2, wherein the distance (a) from the abrupt transition between the generally conical tip portion and the elongated intermediate portion to the radially outermost portion of the rearwardly facing contact surface of the shoulder is larger than the distance (b) from said abrupt transition to the axially forwardmost portion of the generally conical tip portion.

7. A tool according to claim 6, wherein the smallest diameter (d) of the concave surface portion is smaller than the distance (a+b) from the axially forwardmost portion of the generally conical tip portion to the radially outermost portion of the rearwardly facing contact surface of the shoulder.

8. A tool according to claim 7, wherein the concave surface portion has a constant radius of curvature.

9. A tool according to claim 6, wherein the concave surface portion has a constant radius of curvature.

* * * * *